US007651039B2

(12) United States Patent
Suzuki

(10) Patent No.: US 7,651,039 B2
(45) Date of Patent: Jan. 26, 2010

(54) FUEL INJECTION VALVE

(75) Inventor: Keisuke Suzuki, Kariya (JP)

(73) Assignee: Denso Corporation, Kariya (JP)

( * ) Notice: Subject to any disclaimer, the term of this patent is extended or adjusted under 35 U.S.C. 154(b) by 123 days.

(21) Appl. No.: 11/806,729

(22) Filed: Jun. 4, 2007

(65) Prior Publication Data

US 2007/0284455 A1 Dec. 13, 2007

(30) Foreign Application Priority Data

Jun. 8, 2006 (JP) ..... 2006-159256
Jan. 10, 2007 (JP) ..... 2007-002516

(51) Int. Cl.
*F02M 47/02* (2006.01)
*F02M 41/16* (2006.01)
*F02M 61/10* (2006.01)

(52) U.S. Cl. ..... 239/533.8; 239/88; 239/96; 239/533.2

(58) Field of Classification Search ..... 239/88, 239/90–92, 96, 102.2, 533.2, 533.3, 533.8, 239/533.9
See application file for complete search history.

(56) References Cited

U.S. PATENT DOCUMENTS 6,196,193 B1 3/2001 Heinz et al.
6,250,563 B1 * 6/2001 Frank et al. ..... 239/88
6,367,453 B1 4/2002 Igashira et al.
2004/0149838 A1 8/2004 Potschin et al.
2006/0016906 A1 1/2006 Matsumoto

FOREIGN PATENT DOCUMENTS

| | | | |
|---|---|---|---|
| DE | 102 54 750 | A1 | 6/2004 |
| DE | 10 2004 030 447 | A1 | 1/2006 |
| JP | 2001-500218 | | 1/2001 |
| JP | 2001-355534 | | 12/2001 |
| JP | 2006-46323 | | 2/2006 |
| WO | WO 03/004864 | A1 | 1/2003 |
| WO | WO 03/058052 | A1 | 7/2003 |
| WO | WO 2004048769 | A1 * | 6/2004 |

OTHER PUBLICATIONS

European Search Report mailed Sep. 28, 2007 in Application No. 07102105.2.
Chinese Office Action dated Nov. 21, 2008 issued in corresponding Chinese Application No. 200710108292.0 with English Translation.

* cited by examiner

*Primary Examiner*—Darren W Gorman
(74) *Attorney, Agent, or Firm*—Nixon & Vanderhye, PC

(57) ABSTRACT

A fuel injection valve includes a valve chamber, a control valve, an actuator, a control chamber, and a nozzle. The control valve is provided in the valve chamber. The actuator actuates the control valve. The control chamber is always communicated with the valve chamber through a communication passage. The nozzle has a needle for opening and closing an injection orifice, wherein the needle is biased in a valve closing direction for closing the injection orifice by pressure of fuel in the control chamber. High pressure fuel in a high-pressure fuel passage is introduced into the control chamber only through the communication passage in a state, where communication between the valve chamber and the high-pressure fuel passage is allowed by the control valve. The communication passage has a common orifice.

8 Claims, 4 Drawing Sheets

FUEL INJECTION VALVE

CROSS REFERENCE TO RELATED APPLICATION

This application is based on and incorporates herein by reference Japanese Patent Application No. 2006-159256 filed on Jun. 8, 2006 and Japanese Patent Application No. 2007-2516 filed on Jan. 10, 2007.

BACKGROUND OF THE INVENTION

1. Field of the Invention

The present invention relates to fuel injection valve to inject fuel to a heat engine.

2. Description of Related Art

A conventional fuel injection valve disclosed in JP-A-2001-500218 corresponding to U.S. Pat. No. 6,196,193 includes a nozzle, a control valve, an actuator, and a control chamber. Typically, the nozzle has a needle that opens and closes an injection orifice. The control valve is provided inside a valve chamber for selectively connecting the valve chamber with a low-pressure fuel passage or with a high-pressure fuel passage. The actuator actuates the control valve. The control chamber is always communicated with the valve chamber through a communication passage. Fuel pressure in the control chamber biases the needle in a valve closing direction for closing the injection orifice. The control valve controls pressure in the control chamber for controlling the opening and closing the valve of the nozzle.

Also, the following structure is adopted such that a speed of nozzle for opening and closing the valve can be set independently. In other words, at the time of state, where the communication between the valve chamber and the high-pressure fuel passage is allowed, high pressure fuel in the high-pressure fuel passage is introduced into the control chamber only through the communication passage. More particularly, the fuel injection valve includes an out orifice in a low-pressure fuel passage, and an in orifice in the high-pressure fuel passage. According to this, a valve opening speed of the nozzle for opening the injection orifice can be set by the out orifice, and a valve closing speed of the nozzle for closing the injection orifice can be set by the in orifice. Thus, the speed for opening and closing the valve (injection orifice) of the nozzle can be set independently, and flexibility of setting the speed for opening and closing the valve of the nozzle is remarkably high.

However, in the fuel injection valve described in JP-A-2001-500218, as shown in FIG. 8, pressure pulsation is generated in the control chamber at a time of a valve opening of the nozzle. As a result, the needle resonates with pressure pulsation to oscillate, and thereby disadvantageously being lifted. At this time, a lift amount of the needle is not proportional to a drive pulse duration (corresponding to a command value for an injection period). As a result, as shown in FIG. 9, a characteristic curve of the fuel injection quantity with respect to the drive pulse duration disadvantageously is not linear.

SUMMARY OF THE INVENTION

The present invention is made in view of the above disadvantages. Thus, it is an objective of the present invention to address at least one of the above disadvantages.

To achieve the objective of the present invention, there is provided a fuel injection valve, which includes a valve chamber, a control valve, an actuator, a control chamber, and a nozzle. The control valve is provided in the valve chamber, wherein the control valve is engaged with and disengaged from a low-pressure-side seat surface of the valve chamber for prohibiting and allowing communication between the valve chamber and a low-pressure fuel passage, and the control valve is engaged with and disengaged from a high-pressure-side seat surface of the valve chamber for prohibiting and allowing communication between the valve chamber and a high-pressure fuel passage. The actuator actuates the control valve. The control chamber is always communicated with the valve chamber through a communication passage. The nozzle has a needle for opening and closing an injection orifice, wherein the needle is biased in a valve closing direction for closing the injection orifice by pressure of fuel in the control chamber. High pressure fuel in the high-pressure fuel passage is introduced into the control chamber only through the communication passage in a state, where the communication between the valve chamber and the high-pressure fuel passage is allowed. The communication passage has a common orifice.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

One embodiment of the present invention is explained.

A fuel injection valve is mounted on a cylinder head of an internal combustion engine (more particularly, a diesel engine, not shown). The fuel injection valve injects high pressure fuel accumulated in an accumulator (not shown) into a cylinder of the internal combustion engine.

Figure 1:
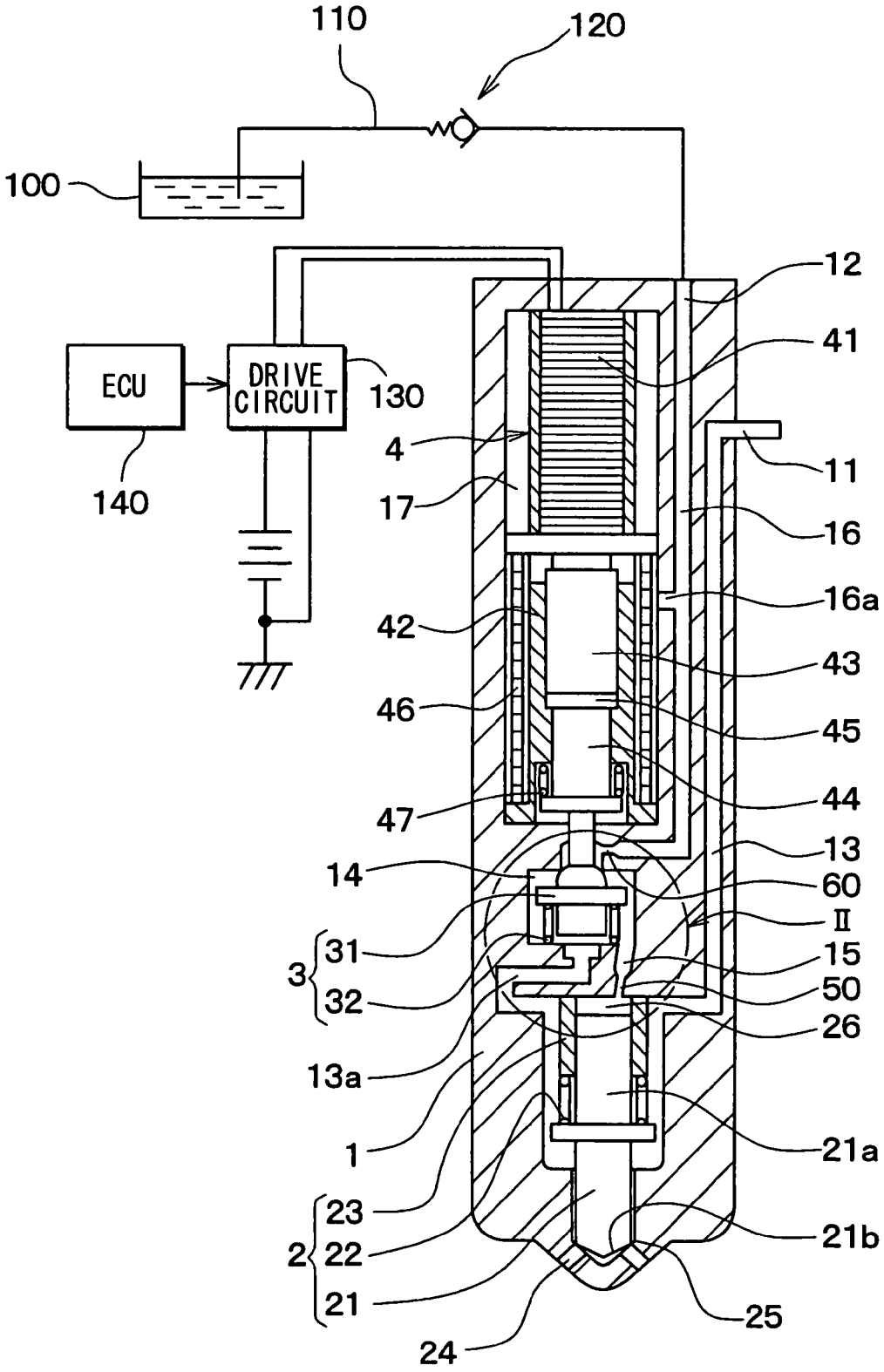
FIG. 1 is a cross-sectional view showing a general structure of a fuel injection system having a fuel injection valve according to one embodiment of the present invention.
Figure 2:
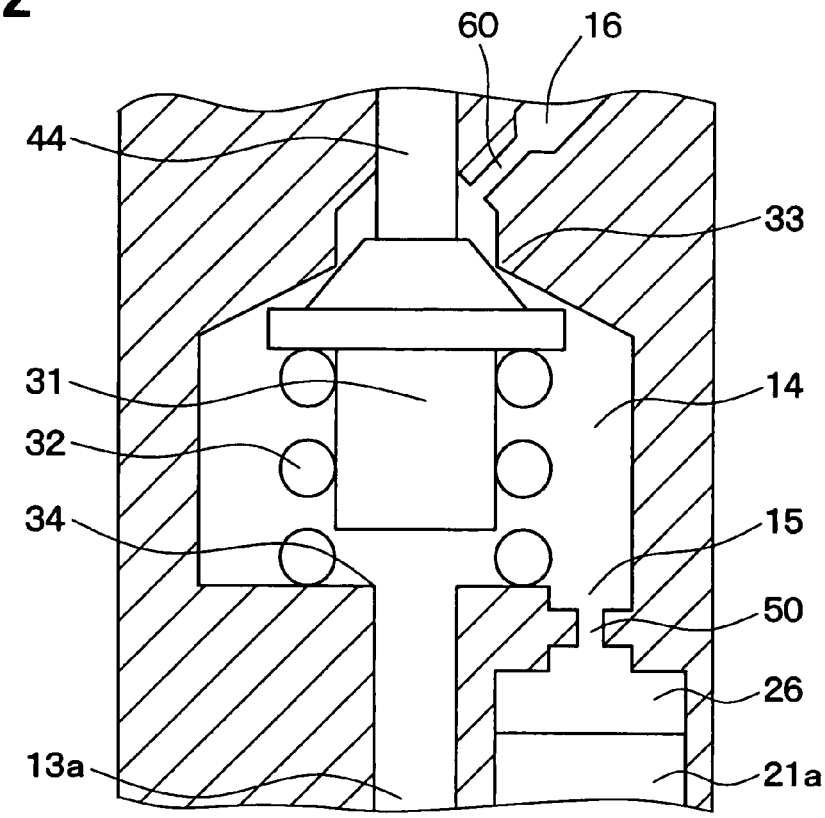
FIG. 2 is an enlarged cross-sectional view of a part 11 of FIG. 1.

As shown in FIG. 1 and FIG. 2, a body 1 of the fuel injection valve includes a fuel inlet port 11, into which high pressure fuel from an accumulator is introduced, and a fuel outlet port 12, through which the fuel inside the fuel injection valve flows to a fuel tank 100.

A nozzle 2, which injects fuel at a valve opening state, where the valve is opened, is placed at one end of the body 1 in a longitudinal direction (at one longitudinal end of the body 1). The nozzle 2 has a needle 21, a nozzle spring 22, and a nozzle cylinder 23. The needle 21 is slidably held by the body 1. The nozzle spring 22 biases the needle 21 in a valve closing direction for closing the valve. The nozzle cylinder 23 receives a piston portion 21*a* of the needle 21.

At the one longitudinal end of the body 1, an injection orifice 24, which communicates with the fuel inlet port 11 through a high-pressure fuel passage 13, is formed, and it is designed that high pressure fuel is injected through the injection orifice 24 into the cylinder of the internal combustion engine. A taper-shaped valve seat 25 is formed upstream of the injection orifice 24, and the injection orifice 24 is opened or closed by engaging and disengaging a seat portion 21*b* formed in the needle 21 with and from the valve seat 25.

The nozzle cylinder 23 slidably and fluid tightly receives a piston portion 21*a*, and the piston portion 21*a* and the nozzle cylinder 23 defines a control chamber 26, in which internal fuel pressure is changed between a high pressure and a low pressure. And the needle 21 is biased in the valve closing direction by fuel pressure in the control chamber 26, and also the needle 21 is biased in the valve opening direction for opening the valve by high pressure fuel, which is introduced from the fuel inlet port 11 toward the injection orifice 24 through the high-pressure fuel passage 13.

In a longitudinal intermediate part of the body 1, a valve chamber 14, which receives a control valve 3 controlling pressure in the control chamber 26, is formed. The control chamber 26 is always communicated with the valve chamber 14 through a communication passage 15. The control chamber 26 is communicated with only the valve chamber 14, more specifically. A common orifice 50 is installed in the communication passage 15 and serves as a restrictor for restricting flow through the communication passage 15.

The valve chamber 14 is connected with a high-pressure communication passage 13*a*, which branches off the high-pressure fuel passage 13. Also, the valve chamber 14 is connected to the fuel outlet port 12 through a low-pressure fuel passage 16. An out orifice 60 is provided to the low-pressure fuel passage 16, and serves as a restrictor for restricting flow through the low-pressure fuel passage 16.

The control valve 3 has a valve element 31 and a valve spring 32. The valve element 31 is engaged with and disengaged from a low-pressure-side seat surface 33 to prohibit and allow communication between the valve chamber 14 and the low-pressure fuel passage 16, and the valve element 31 is engaged with and disengaged from a high-pressure-side seat surface 34 to prohibit and allow communication between the valve chamber 14 and the high-pressure communication passage 13*a*. The valve spring biases the valve element 31 in a direction for opening (allowing) the communication between the valve chamber 14 and the high-pressure communication passage 13*a* and at the same time for closing (prohibiting) the communication between the valve chamber 14 and the low-pressure fuel passage 16.

An actuator chamber 17, which receives an actuator 4 driving the control valve 3, is formed at the other longitudinal end of the body 1. The actuator chamber 17 is connected to the low-pressure fuel passage 16 through a low-pressure communication passage 16*a*.

The actuator 4 includes a piezoelectric stack 41 and a transmission portion. The piezoelectric stack 41 has multiple piezoelectric elements, which are laminated onto one another, and expands and contracts by charging and discharging the electric charge. The transmission portion transmits a displacement of the piezoelectric stack 41, which is caused by the expansion and contraction, to the valve element 31 of the control valve 3.

The transmission portion is constructed as follows. A first piston 43 and a second piston 44 are slidably and fluid tightly received by an actuator cylinder 42, and a fluid chamber 45, which is filled with fuel is provided between the first piston 43 and the second piston 44.

The first piston 43 is biased toward the piezoelectric stack 41 by a first spring 46, and is driven by the piezoelectric stack 41 directly. And, at the time of the extension of the piezoelectric stack 41, pressure in the fluid chamber 45 is raised by the first piston 43.

The second piston 44 is biased toward the valve element 31 of the control valve 3 by a second spring 47, and is operated to drive the valve element 31 by pressure in the fluid chamber 45. At the time of the extension of the piezoelectric stack 41, pressure in the fluid chamber 45, which is made higher, drives the second piston 44 such that the communication between the valve chamber 14 and the high-pressure communication passage 13*a* is prohibited. Along with this, the second piston 44 drives the valve element 31 in a position, where the communication between the valve chamber 14 and the low-pressure fuel passage 16 is allowed. In contrast, at a time of contraction of the piezoelectric stack 41, namely when pressure in the fluid chamber 45 is low, the second piston 44 resists the second spring 47, and is pushed back by the valve spring 32 of the control valve 3 toward the first piston 43.

A return passage 110 connects the fuel outlet port 12 with the fuel tank 100, and the return passage 110 has a back-pressure valve 120 at one side thereof toward the low-pressure fuel passage 16 for controlling pressure in the low-pressure fuel passage 16. By the way, the back-pressure valve 120 controls the pressure in the low-pressure fuel passage 16 at generally 1 MPa whereas pressure in high pressure fuel accumulated in the accumulator is equal to or greater than 100 MPa.

An electric power is supplied through a piezoelectric drive circuit 130 to the piezoelectric stack 41. Electrification timing of the piezoelectric drive circuit 130 to the piezoelectric stack 41 is controlled by an electronic control circuit (hereinafter, referred as ECU) 140.

The ECU 140 includes a known microcomputer having a CPU, ROM, an EEPROM, and a RAM, all of which are not illustrated, and executes computing processes in accordance with programs stored in the microcomputer. Signals are inputted into the ECU 140 through various sensors (not shown) detecting an intake air amount, a depression amount of an accelerator pedal, a rotational speed of the internal combustion engine, and fuel pressure in the accumulator.

An operation of the fuel injection valve is described below. When the piezoelectric stack 41 is energized, the piezoelectric stack 41 expands and the first piston 43 is driven to raise pressure in the fluid chamber 45. The second piston 44 is driven toward the valve element 31 of the control valve 3 by pressure in the fluid chamber 45, which is thus made higher.

Then, because the valve element 31 is driven with the second piston 44, the valve element 31 contacts with (is engaged with) the high-pressure-side seat surface 34 such that the communication between the valve chamber 14 and the high-pressure communication passage 13*a* is prohibited. Along with this, the valve element 31 is placed apart from (is disengaged from) the low-pressure-side seat surface 33 such that the communication between the valve chamber 14 and the low-pressure fuel passage 16 is allowed. Thus, fuel in the control chamber 26 is returned to the fuel tank 100 through the common orifice 50, the communication passage 15, the valve chamber 14, the out orifice 60, and the low-pressure fuel passage 16.

Due to this, pressure in the control chamber 26 falls and the force biasing the needle 21 in the valve closing direction is reduced. Thus, the needle 21 moves in the valve opening direction so that the seat portion 21*b* is disengaged from the valve seat 25. As a result, the injection orifice 24 is opened, and fuel is injected into the cylinder of the internal combustion engine through the injection orifice 24.

Figure 3:
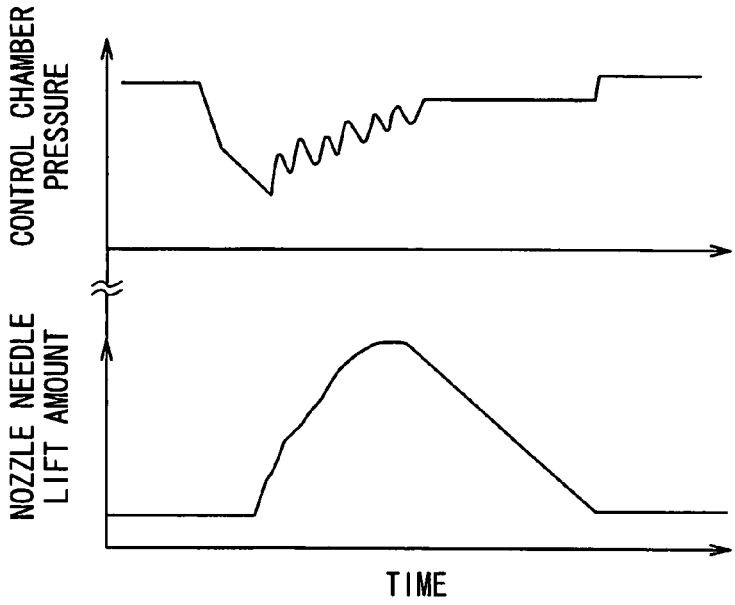
FIG. 3 is a characteristic chart showing pressure in a control chamber and a lift amount of a needle according to the fuel injection valve of FIG. 1.
Figure 4:
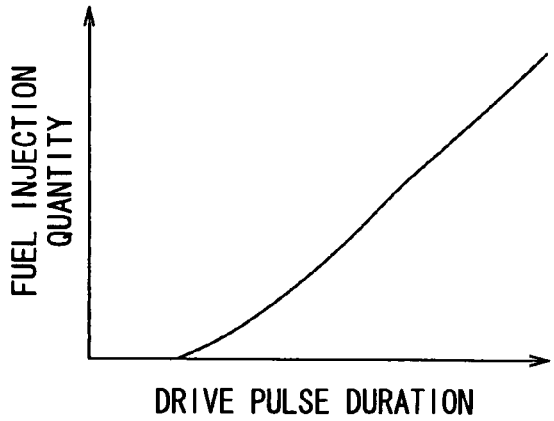
FIG. 4 is a characteristic chart showing a relation between a drive pulse duration and a fuel injection quantity according to the fuel injection valve of FIG. 1.

At the time of this valve opening operation, because the pressure transmission from the control chamber 26 to the valve chamber 14 is restrained with the common orifice 50 (e.g., this means reduction of the dead volume in the control chamber 26), the frequency of the pressure pulsation in the control chamber 26 is raised, and therefore, the resonance of the needle 21 is limited as shown in FIG. 3. As a result, the lift amount of the needle 21 becomes generally proportional to a drive pulse duration, and the characteristic of the fuel injection quantity relative to the drive pulse duration is generally linear as shown in FIG. 4.

After this, when energization to the piezoelectric stack 41 is stopped, the piezoelectric stack 41 contracts, and therefore the first piston 43 is returned toward the piezoelectric stack 41 by the first spring 46. Also, by the valve spring 32, the valve element 31 and the second piston 44 are returned toward the first piston 43.

Due to this, the valve element 31 is separated apart from (is disengaged from) the high-pressure-side seat surface 34 such that the communication between the valve chamber 14 and the high-pressure communication passage 13*a* is allowed. Along with this, the valve element 31 contacts with (is engaged with) the low-pressure-side seat surface 33 such that the communication between the valve chamber 14 and the low-pressure fuel passage 16 is prohibited. Thus, high pressure fuel from accumulator is introduced into the control chamber 26 through the high-pressure fuel passage 13, the high-pressure communication passage 13*a*, the valve chamber 14, the communication passage 15, and the common orifice 50.

As a result, pressure in the control chamber 26 rises, and therefore, a biasing force that biases the needle 21 in the valve closing direction becomes larger. Therefore, the needle 21 moves in the valve closing direction, and the seat portion 21*b* seats on (is engaged with) the valve seat 25 such that the injection orifice 24 is closed. Thus, the fuel injection is finished.

Next, the followings are defined. The common orifice 50 has a diameter (first diameter) of ϕd1 and the out orifice 60 has a diameter (second diameter) of ϕd2. An orifice diameter ratio is defined as Rori (Rori=ϕd1/ϕd2). A flow amount per unit time (hereinafter, referred as fuel discharge speed) of fuel discharged from the control chamber 26 through both the orifices 50, 60 to the fuel tank 100 is defined as Qout. A certain fuel discharge speed in a state, where the orifice diameter ratio Rori is infinite, is defined as a reference fuel discharge speed Qout−std and a fuel discharge speed ratio is defined as Rq (Rq=Qout/Qout−std). In the above definition, a relation between the orifice diameter ratio Rori and the fuel discharge speed ratio Rq is explained.

Figure 5:
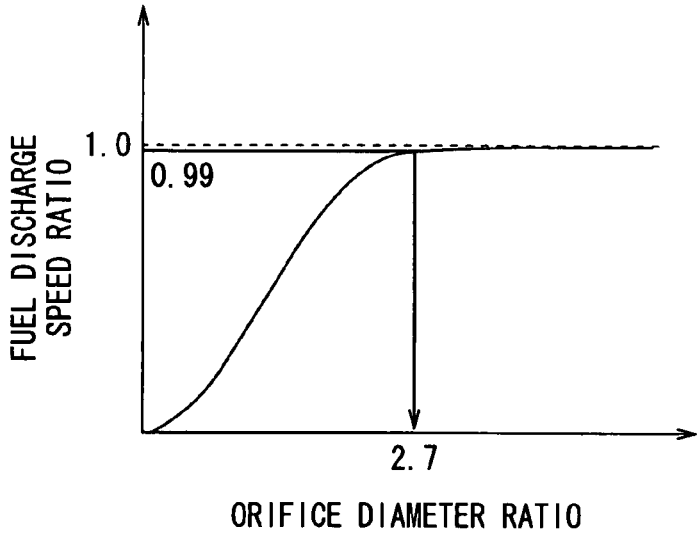
FIG. 5 is a chart showing a relation between an orifice diameter ratio and the fuel discharge speed ratio in the fuel injection valve of FIG. 1.

FIG. 5 shows the examination result. For example, this indicates that fuel discharge speed ratio Rq≧0.99 and hardly changes when Rori≧2.7. Therefore, by setting the orifice diameter ratio Rori as equal to or greater than 2.7, the fuel discharge speed Qout, which relates to the valve opening speed of the nozzle for opening the injection orifice 24, can be set by the out orifice 60 with little influence from the common orifice 50.

By the way, fuel introduced to the control chamber 26 at a time of the valve closing of the nozzle does not pass through the out orifice 60. Therefore, the valve closing speed of the nozzle for closing the injection orifice 24 can be set by a flow amount in the route through the high-pressure communication passage 13*a*, the high-pressure-side seat surface 34, and the common orifice 50. Thus, the valve opening speed and the valve closing speed of the nozzle can be set independently by setting the orifice diameter ratio Rori equal to or larger than 2.7.

Next, a relation between the diameter ϕd1 of the common orifice 50 and the linearity (called hereinafter, the TQ-Q linearity) of the drive pulse duration TQ relative to the fuel injection quantity Q is described below.

Figure 6:
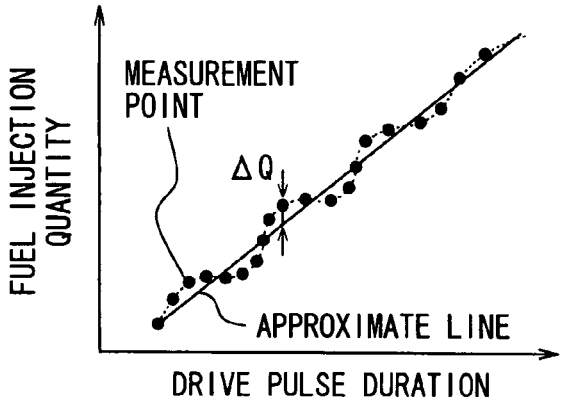
FIG. 6 is a chart showing a relation between the drive pulse duration and the fuel injection quantity for explanation of a TQ-Q linearity.

At first, a definition of the TQ-Q linearity is explained. As shown in FIG. 6, an approximate straight line is found through the measured value (hereinafter, referred as a measured injection quantity) of the fuel injection quantity relative to the drive pulse duration. And in a state, where a difference between the measured injection quantity and an injection quantity found by the approximate straight line is indicated as an injection-quantity error ΔQ, a standard deviation of the injection-quantity error ΔQ is defined as TQ-Q linearity. By the way, as a numerical value of the TQ-Q linearity becomes smaller, a relation between the drive pulse duration and the fuel injection quantity becomes more proportional, and therefore, a characteristic line between the drive pulse duration and the fuel injection quantity becomes more linear.

Figure 7:
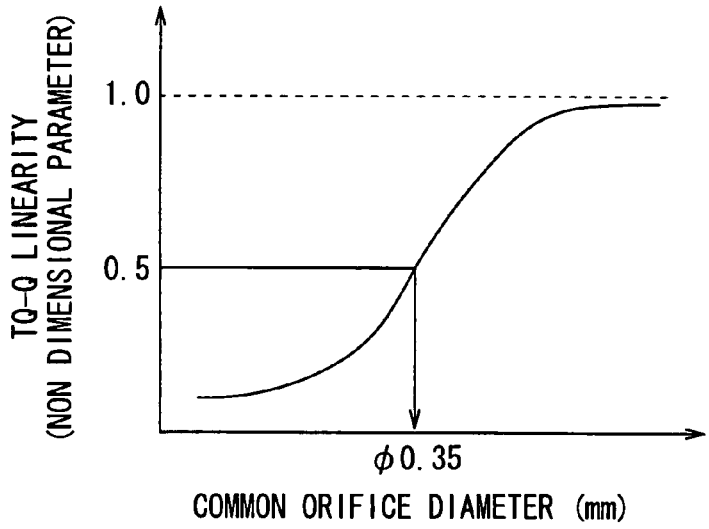
FIG. 7 is a chart showing a relation between a common orifice diameter and the TQ-Q linearity in the fuel injection valve of FIG. 1.
Figure 8:
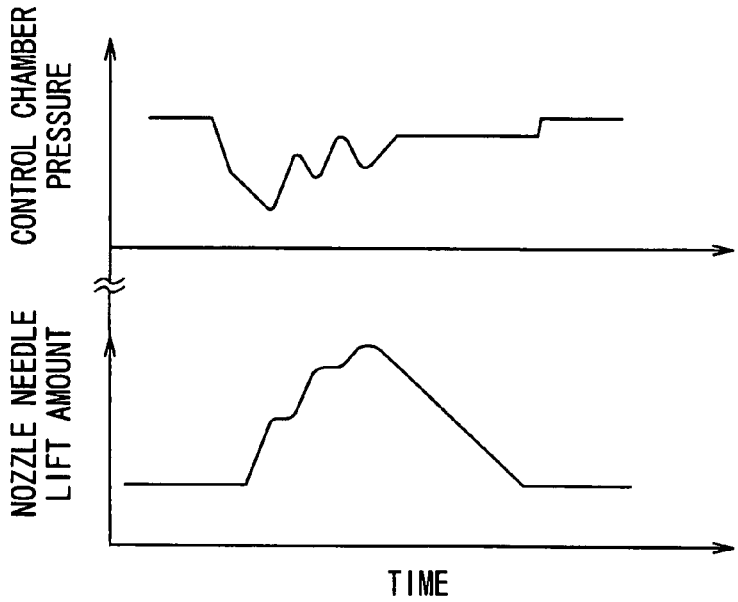
FIG. 8 RELATED ART
FIG. 8 is a characteristic chart showing a lift amount of a needle and pressure in a control chamber in a conventional fuel injection valve.
Figure 9:
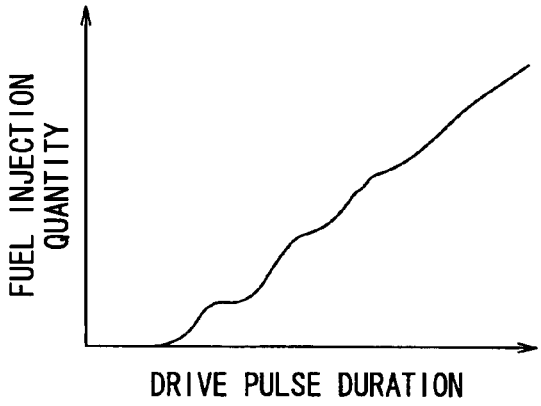
FIG. 9 RELATED ART
FIG. 9 is a characteristic chart showing a relation between a drive pulse duration and the fuel injection quantity in the conventional fuel injection valve.

FIG. 7 shows a relation between the diameter ϕd1 of the common orifice 50 and the TQ-Q linearity. For example, the TQ-Q linearity indicates 0.5 when the diameter ϕd1 is equal to 0.35 mm. Therefore, the characteristic of the fuel injection quantity relative to the drive pulse duration can be linear by setting the diameter ϕd1 of the common orifice 50 equal to or less than 0.35 mm (i.e., ϕd1≦0.35 mm). Thus, pressure transmission from the control chamber 26 to the valve chamber 14 is reliably controlled by the common orifice 50 during the valve opening of the nozzle, and thereby a characteristic of the fuel injection quantity relative to the drive pulse duration can be more linear.

According to the present embodiment, the resonance of the needle 21 during the valve opening of the nozzle is restrained, and as a result, the lift amount of the needle 21 becomes generally proportional relative to the drive pulse duration. Thus, the characteristic of the fuel injection quantity relative to the drive pulse duration becomes linear.

Also, the flow velocity of fuel introduced into the control chamber 26 is controlled by the flow amount that flows in the route through the high-pressure communication passage 13*a*, the high-pressure-side seat surface 34, and the common orifice 50, and therefore, the valve closing speed of the nozzle is set as required. Also, the flow velocity of fuel discharged from the control chamber 26 is controlled by the out orifice 60, and therefore the valve opening speed of the nozzle can be set as required.

At this time, by making the diameter of the common orifice 50 sufficiently larger than the diameter of the out orifice 60, contribution for controlling the flow velocity of the fuel discharged through the control chamber 26 (i.e., the valve opening speed of the needle) by the out orifice 60 is significantly large relative to the common orifice 50. Typically, the flow velocity (the valve opening speed) is determined by the double restrictors of the common orifice 50 and the out orifice 60.

Additional advantages and modifications will readily occur to those skilled in the art. The invention in its broader terms is therefore not limited to the specific details, representative apparatus, and illustrative examples shown and described.

What is claimed is:

1. A fuel injection valve comprising:

a valve chamber;

a control valve that is provided in the valve chamber, wherein:

the control valve is engaged with and disengaged from a low-pressure-side seat surface of the valve chamber for prohibiting and allowing communication between the valve chamber and a low-pressure fuel passage; and the control valve is engaged with and disengaged from a high-pressure-side seat surface of the valve chamber for prohibiting and allowing communication between the valve chamber and a high-pressure fuel passage;

an actuator that actuates the control valve;

a control chamber that is always communicated with the valve chamber through a communication passage; and a nozzle that has a needle for opening and closing an injection orifice, wherein the needle is biased in a valve closing direction for closing the injection orifice by pressure of fuel in the control chamber, wherein:

high pressure fuel in the high-pressure fuel passage is introduced into the control chamber only through the communication passage in a state, where the communication between the valve chamber and the high-pressure fuel passage is allowed;

the communication passage has a common orifice having a first diameter;

the low-pressure fuel passage has an out orifice having a second diameter; and the first diameter is larger than the second diameter.

2. The fuel injection valve according to claim 1, wherein:

the first diameter of the common orifice is $\phi d1$;

the second diameter of the out orifice is $\phi d2$; and $\phi d1/\phi d2 \geqq 2.7$.

3. The fuel injection valve according to claim 1, wherein:

the first diameter of the common orifice is $\phi d1$; and $\phi d1 \leqq 0.35$ mm.

4. The fuel injection valve according to claim 2, wherein $\phi d1 \leqq 0.35$ mm.

5. The fuel injection valve according to claim 1, wherein the common orifice serves as a restrictor for restricting flow through the communication passage.

6. The fuel injection valve according to claim 1, wherein the out orifice serves as a restrictor for restricting flow through the low-pressure fuel passage.

7. The fuel injection valve according to claim 1, wherein the control chamber has a volume smaller than a volume of the valve chamber.

8. The fuel injection valve according to claim 1, wherein high pressure fuel in the high-pressure fuel passage is prevented from being introduced into the control chamber when the control valve is engaged with the high-pressure-side seat surface of the valve chamber.

* * * * *